United States Patent [19]

Minamizono et al.

[11] 4,343,894

[45] Aug. 10, 1982

[54] PHOTOGRAPHIC LIGHT-SENSITIVE ELEMENT WITH ANTISTATIC PROTECTIVE LAYER

[75] Inventors: Junji Minamizono; Shinzo Kishimoto; Masakazu Yoneyama, all of Minami-ashigara, Japan

[73] Assignee: Fuji Photo Film Co., Ltd., Kanagawa, Japan

[21] Appl. No.: 197,355

[22] Filed: Oct. 15, 1980

[30] Foreign Application Priority Data

Oct. 15, 1979 [JP] Japan ..... 54-132537

[51] Int. Cl.[3] ..... G03C 1/78

[52] U.S. Cl. ..... 430/528; 430/529; 430/961

[58] Field of Search ..... 430/528, 529, 518, 627, 430/630, 961

[56] References Cited

U.S. PATENT DOCUMENTS

| | | | |
|---|---|---|---|
| 2,548,564 | 4/1947 | Sprague et al. | 430/528 |
| 3,068,215 | 12/1962 | Laakso et al. | 430/528 |
| 3,399,995 | 9/1968 | Winchell | 430/528 |
| 3,816,129 | 6/1974 | Fitzgerald | 420/627 |
| 3,925,083 | 12/1975 | Fitzgerald | 430/627 |
| 4,013,696 | 3/1977 | Babbit et al. | 430/961 |

OTHER PUBLICATIONS

Merck Index, 9th Edition, p. 1208 (1976).

*Primary Examiner*—Jack P. Brammer
*Attorney, Agent, or Firm*—Sughrue, Mion, Zinn, Macpeak & Seas

[57] ABSTRACT

The antistatic properties of a photographic light-sensitive member is improved by adding to a surface protective layer a polymer or copolymer having a repeating unit represented by the formula (I)

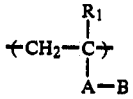

(I)

wherein $R_1$ represents hydrogen or a methyl group, A represents a —COO— or —CONH— group, and B represents

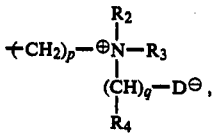

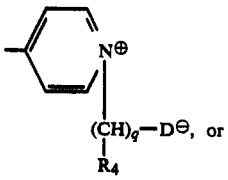

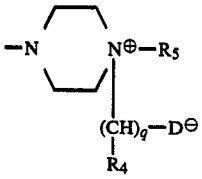

wherein $R_2$ and $R_3$ represent an alkyl group containing from 1 to 6 carbon atoms; $R_4$ represents hydrogen or a methyl group; $R_5$ represents an alkyl group containing from 1 to 3 carbon atoms; p is an integer of 2 to 6, q, when $R_4$ is hydrogen, is an integer of from 1 to 4, and when $R_4$ is a methyl group, is 1; and D represents a —COO or —$SO_3$ group.

22 Claims, No Drawings

PHOTOGRAPHIC LIGHT-SENSITIVE ELEMENT WITH ANTISTATIC PROTECTIVE LAYER

BACKGROUND OF THE INVENTION

1. Field of the Invention

This invention relates to photographic light-sensitive silver halide members which are improved in antistatic properties, and more particularly to photographic light-sensitive silver halide members which are improved in antistatic properties without exerting adverse influences on the photographic characteristics of the photographic members.

2. Description of the Prior Art

When photographic light-sensitive members are brought into contact with each other or the surface of a different substance, or stripped during the production or use thereof, electrostatic charges are often accumulated thereon by the contact friction or stripping, because they usually comprise an electrically insulating support and a photographic layer or layers.

These accumulated electrostatic charges give rise to various problems. The most serious problem is that a light-sensitive emulsion layer may be exposed to light by discharge of the electrostatic charges; that is, when a photographic film is developed, dot-like spots, or branch- or feather-like lines, appear therein. These are called "static marks", and significantly reduce the product value of such photographic films. In some cases, the product value is completely lost. It can easily be understood that such static marks appearing, for example, in medical or industrial X-ray films, may lead to a misdiagnosis and inappropriate decision based thereon. This problem is made more troublesome by the fact that the occurrence of such a phenomenon is only revealed by development of the photographic image. Additionally, the accumulated electrostatic charges may give rise to secondary problems, such as that dust is attracted onto the surface of film by the action of the charges, and a uniform coating cannot be obtained.

As described above, the electrostatic charges are often accumulated on the photographic light-sensitive members by the contact friction or stripping during the production or use thereof. In the production process, for example, the contact friction between the photographic film and a roller or the stripping or separation of the emulsion layer from the back side of the support can cause the accumulation of the electrostatic charges. In the case of finished articles, the separation of the emulsion layer from the back side of the support which occurs in winding or exchanging the photographic film, or the stripping due to the contact of, e.g., an X-ray film with mechanical parts in an automatic camera or a fluorescent intensifying screen, may lead to the accumulation of the electrostatic charges. Additionally, electrostatic charges may be caused by contact of the film with wrapping materials.

The static marks induced on the photographic light-sensitive member by the accumulation of electrostatic charges become significant with a raise in the sensitivity of the photographic light-sensitive member and an increase in the processing speed. Recently, the formation of such static marks has become a more severe problem, since photographic light-sensitive members having increased sensitivity have become available and more widely used, and due to the use of high-speed coating, high-speed photographing, high-speed automatic processing, etc.

The best method for overcoming the problems caused by static electricity that has been found is to increase the electrical conductivity, so as to allow electrostatic charges to be dissipated prior to the discharge of accumulated electrostatic charges.

Therefore, a method of increasing the electrical conductivity of a support for use in photographic light-sensitive members or of various coated surface layers has heretofore been studied, and attempts have been made to utilize various hygroscopic substances and water-soluble inorganic salts, certain surface active agents, polymers, etc. For example, polymers as described in U.S. Pat. Nos. 2,882,157, 2,972,535, 3,062,785, 3,262,807, 3,514,291, 3,615,531, 3,753,716, 3,938,999, etc., surface active agents as described in U.S. Pat. Nos. 2,982,651, 3,428,456, 3,457,076, 3,454,625, 3,552,972, 3,655,387, etc., zinc oxide, semiconductors, colloidal silica, etc., as described in U.S. Pat. Nos. 3,062,700, 3,245,833, 3,525,621, etc., are known.

Many of these substances, however, vary in capability depending upon the type of the support and the photographic composition; that is, when they are used in certain specific film supports, photographic emulsions, or other photographic elements, good results can be used, while when used in other film supports or photographic elements, they not only have no antistatic capability, but also exert adverse influences on the photographic characteristics.

In particular, it is difficult to prevent the hydrophilic colloidal layer from becoming charged; particularly, the reduction in the surface resistance at low humidities is not sufficient, and the problem of adhesion between the photographic light-sensitive members themselves or between the photographic light-sensitive members and other substances at high temperatures and humidities often occurs.

Furthermore, the above-described substances often cannot be used because they exert adverse influences on the photographic characteristics, such as the sensitivity of a photographic emulsion, fog, granularity, image sharpness, etc., or yield the scum in a fixer, even though they may have an excellent antistatic effect. For example, while it is generally known that polyethyleneoxide based compounds have an antistatic effect, they often exert adverse influences on photographic characteristics, such as an increase in fog, desensitization, deterioration in granularity, etc. In particular, it has been difficult to impart the desired antistatic properties to light-sensitive members comprising a support and photographic emulsions coated on both sides of the support, such as medical direct X-ray light-sensitive members, without exerting adverse influences on the photographic characteristics thereof.

SUMMARY OF THE INVENTION

An object of this invention is to provide photographic light-sensitive members having improved antistatic properties.

Another object of this invention is to provide a method of effectively imparting antistatic properties to photographic light-sensitive members, without exerting adverse influences on the photographic characteristics thereof, e.g., sensitivity, photographic fog, granularity, image sharpness, etc.

A further object of this invention is to provide photographic light-sensitive members having improved antistatic properties which form no scum in a fixer.

DETAILED DESCRIPTION OF THE INVENTION

It has now been found according to this invention that the above objects can be attained by incorporating in a surface protective layer a polymer or copolymers having a repeating unit of the betaine structure represented by the formula (I)

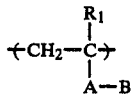

(I)

wherein $R_1$ represents hydrogen or a methyl group, A represents a —COO— or —CONH— group, and B represents

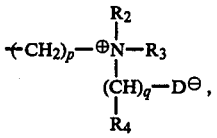

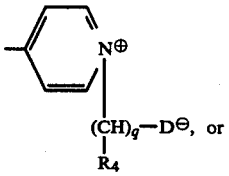

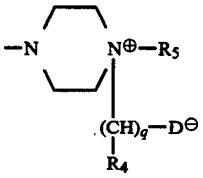

wherein $R_2$ and $R_3$ represent an alkyl group containing from 1 to 6 carbon atoms, e.g., a methyl group and an ethyl group; $R_4$ represents hydrogen or a methyl group; $R_5$ represents an alkyl group containing from 1 to 3 carbon atoms; p is an integer of from 2 to 6; q, when $R_4$ is hydrogen, is an integer of from 1 to 4, and, when $R_4$ is a methyl group, is 1; and D represents a —COO or —$SO_3$ group.

Among the repeating units represented by the formula (I), the repeating unit represented by the following formula (II) are particularly preferred:

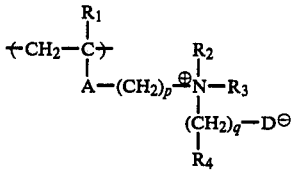

(II)

wherein A, $R_1$, $R_2$, $R_3$, $R_4$, p, q and D are the same as defined above.

The polymer incorporated in a surface protective layer according to this invention may be a homopolymer having a repeating unit of the formula (I) or may be a copolymer obtained from a monomer of the formula (I) and comonomers. Examples of the comonomers that can be used in the formation of copolymers according to the invention include acrylic acid, methacrylic acid and their alkyl esters (e.g., methyl methacrylate, ethyl acrylate, hydroxyethyl acrylate, propyl acrylate, cyclohexyl acrylate, 2-ethylhexyl acrylate, decyl acrylate, β-cyanoethyl acrylate, β-chloroethyl acrylate, 2-ethoxyethyl acrylate, sulfopropyl methacrylate, etc.), vinyl esters (e.g., vinyl acetate, vinyl propionate, vinyl butyrate, etc.), vinyl ethers (e.g., methyl vinyl ether, butyl vinyl ether, oleyl vinyl ether, etc.), vinyl ketones (e.g., methyl vinyl ketone, ethyl vinyl ketone, etc.), styrenes (e.g., styrene, methylstyrene, dimethylstyrene, 2,4,6-trimethylstyrene, ethylstyrene, laurylstyrene, chlorostyrene, methoxystyrene, cyanostyrene, chloromethylstyrene, vinylbenzoic acid, styrenesulfonic acid, α-methylstyrene, etc.), vinyl heterocyclic compounds (e.g., vinylpyridine, vinylpyrrolidone, vinylimidazole, etc.), acrylonitrile, vinyl chloride, vinylidene chloride, ethylene, propylene, butadiene, diisobutylene, isoprene, chloroprene, etc. This invention is not limited to the above-described copolymerizable monomers, and any copolymers having the above structural unit can be used. Preferred copolymers are those comprising at least 50 mol% of the units represented by the formula (I).

Example of typical homopolymers or copolymers for use in this invention are shown below. Copolymerization ratios (x, y) are illustrative, and this invention is not limited thereto.

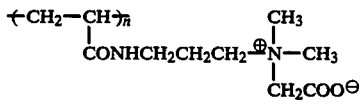

(1)

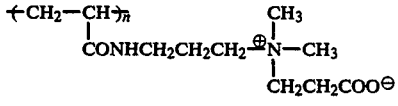

(2)

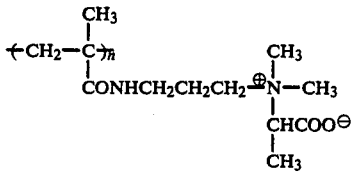

(3)

-continued

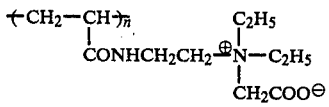

(4)

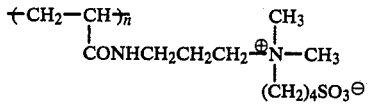

(5)

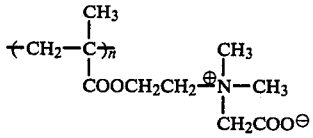

(6)

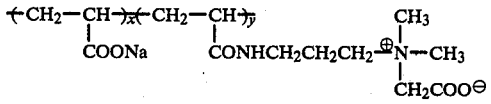

x:y = 10:90

(7)

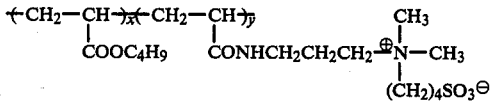

x:y = 40:60

(8)

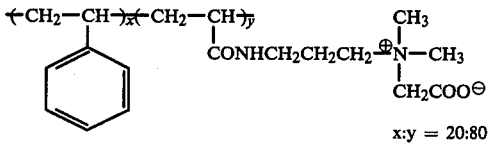

x:y = 20:80

(9)

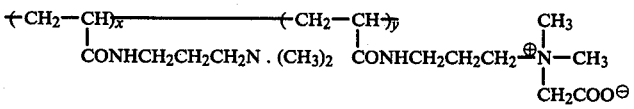

x:y = 10:90

(10)

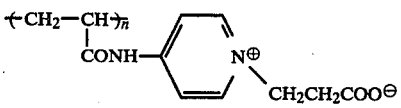

(11)

These compounds can be synthesized by referring to the methods described, for example, in U.S. Pat. Nos. 2,846,417, 3,411,912, 3,832,185, and Japanese Patent Publication No. 30293/71.

Hereinafter, the preparation of typical examples of the polymers or copolymers having the repeating unit represented by the formula (I) will be described.

PREPARATION EXAMPLE 1

Preparation of Starting Material for Compound (1)

In a reactor were placed 94.5 g (1 mol) of monochloroacetic acid and 350 ml of methanol, and they were stirred while cooling with ice water. To this mixture was gradually dropwise added 193 g of a 28% methanol solution of sodium methylate so that the temperature of the resulting mixture did not exceed 30° C. Then, a mixed solution of 156.2 g of N-(N',N'-dimethyl-3-aminopropyl)acrylamide represented by the formula:

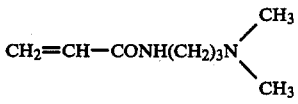

and 300 ml of methanol was added (at thie time, 0.5 g of phenothiazine was also added, as a polymerization inhibitor).

Thereafter, the reaction system was heated to a temperature of about 60° C., and the stirring was continued for 10 hours.

After the reaction was completed, the NaCl formed was removed, and the reaction product was crystallized in a large amount of acetone. The identification of the reaction product was carried out by NMR analysis, elemental analysis, infrared absorption spectrography, and so forth. The yield was 145 g (about 68%).

PREPARATION EXAMPLE 2

Preparation of Compound (1)

In a reactor were placed 50 g of the compound as shown in Preparation Example 1 and 150 ml of methanol, and they were stirred in nitrogen while heating at 60° C. To this mixture was dropwise added 20 ml of methanol containing 0.2 g of AIBN (azobisisobutyronitrile) represented by the formula:

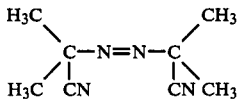

and the stirring was continued for 10 hours. After the reaction was completed, the reaction mixture was subjected to dialysis to remove the unreacted monomers and then freeze-dried to thereby obtain hygroscopic white powder. The yield was 41 g (82%).

PREPARATION EXAMPLE 3

Preparation of Compound (6)

In a three necked flask were placed 157.2 g (1 mol) of N,N-dimethylaminoethyl methacrylate and 150 ml of methyl ethyl ketone, and they were stirred in nitrogen at −20° C. To this mixture was dropwise added a mixed solution of 72.1 g of χ-propiolactone and 100 ml of methyl ethyl ketone. At this time, the temperature in the system was controlled so that it did not exceed −10° C. When the reaction solution was maintained at −20° C. overnight, white crystals were obtained. The yield was 98%.

The identification of the compounds was carried out by usual methods.

On polymerizing the thus-obtained betaine monomer in the same manner as explained in Preparation Example 2, white powder constituting a polymer of formula (6) is obtained.

The polymers or copolymer having the repeating unit of the formula (I) are added to the surface protective layer of photographic light-sensitive members. By the term "surface protective layer", as used in this invention, is meant a surface layer which is present on the light-sensitive silver halide emulsion layer of the photographic light-sensitive members. Usually, it contains as a binder a hydrophilic colloid such as gelatin and, if necessary, it can contain a surface active agent, a gelatin hardener, a matting agent, a lubricant, a polymer latex, etc.

The polymers or copolymers having the repeating unit of the formula (I) as used in this invention are dissolved in water, methanol or a mixed solution thereof and then added to a coating solution for use in the formation of the surface protective layer. The resulting mixture is coated by a dip coating method, an air knife coating method, or an extrusion coating method using a hopper as described, e.g., in U.S. Pat. No. 2,681,294. Alternatively, two or more layers are coated at the same time by methods as described in U.S. Pat. Nos. 3,508,947, 2,941,898, 3,526,528, etc., or a photographic light-sensitive member is dipped in an antistatic solution containing the polymers or copolymers having the repeating unit of the formula (I) according to this invention. Furthermore, if desired, an antistatic solution containing the compounds of this invention is coated on the protective layer.

The amount of the polymer or copolymer having the repeating unit of the formula (I) used is preferably from 0.005 to 5 g per square meter of the photographic film, and more preferably from 0.01 to 1.0 g per square meter of the photographic film.

Of course, the above range varies depending upon the type of photographic base, photography, composition, form or coating method.

As a support for photographic light-sensitive members of this invention, a cellulose nitrate film, a cellulose acetate film, a cellulose acetate butyrate film, a cellulose acetate propionate film, a polystyrene film, a polyethylene terephthalate film, a polycarbonate film, laminated products thereof, etc., can be used. In addition, a baryta paper and an α-olefin (containing from 2 to 10 carbon atoms) polymer (e.g., polyethylene, polypropylene, an ethylene-butene copolymer, etc.) coated or laminated paper can be used.

Depending upon the purpose for which the photographic light-sensitive member is used, a transparent or opaque support can be used. As a transparent support, not only a colorless, transparent support, but also a transparent support colored by addition of dye or pigment can be used.

When the adhesion strength between the support and the photographic emulsion layer is not sufficient, a layer having adhesion properties to both the support and photographic emulsion layer is ordinarily provided as an undercoating layer. In order to further improve the adhesion properties, the surface of the support may be subjected to pre-treatments which are commonly used, for example, corona discharge, irradiation with ultraviolet rays, flame treatment, etc.

In the photographic light-sensitive members of this invention, the surface protective layer and other photographic layers can contain the following binders: for example, as hydrophilic colloids, proteins such as gelatin, colloidal albumin, casein, etc.; cellulose compounds such as carboxymethyl cellulose, hydroxyethyl cellulose, etc.; sugar derivatives such as agar, sodium alginate, starch derivatives, etc.; synthetic hydrophilic colloids such as polyvinyl alcohol, poly-N-vinylpyrrolidone, polyacrylic acid copolymers, polyacrylamide or their derivatives, or partially hydrolyzed products thereof, etc. These colloids are used, if desired, in admixtures comprising two or more thereof.

Of these binders, gelatin is most commonly used. The term "gelatin" as herein used includes the so-called lime-treated gelatin, acid-treated gelatin and enzyme-treated gelatin. A part or the whole of gelatin can be replaced by a synthetic polymeric substance. Additionally, so-called gelatin derivatives, i.e., those products obtained by treating or modifying the functional groups contained in gelatin (e.g., an amino group, an imino group, a hydroxy group or a carboxy group) with a reagent containing one group capable of reacting the group, or those obtained by replacing by graft polymers to which molecular chains of high polymeric substances are bonded, can be used.

Silver halide emulsions for use in the production of the photographic light-sensitive members of this invention are usually produced by mixing a solution of a water-soluble silver salt (e.g., silver nitrate) and a solution of a water-soluble halogen salt (e.g., potassium bromide) in the presence of a solution of a water-soluble polymer such as gelatin. As this silver halide, mixed silver halides, such as silver chlorobromide, silver iodobromide, silver chloroiodobromide, etc., as well as silver chloride and silver bromide can be used.

These silver halide particles are produced by well known and conventional methods. For example, the so-called single jet method, double jet method, control double jet method, etc., are useful. These photographic emulsions can be prepared by the ammonia method, neutral method, acidic method, etc., which are generally used and described in C.E.K. Mees, *The Theory of the Photographic Process,* 3rd Ed., Macmillan Co., P. Glafikides, *Chimie Photographique,* Paul Montel, etc. The thus-prepared silver halide particles can be raised in sensitivity without being made larger, by heating in the presence of chemical sensitizers (e.g., sodium thiosulfate, N,N,N'-trimethylthiourea, a thiocyanate complex salt of univalent gold, a thiosulfuric acid complex salt of univalent gold, stannous chloride, hexamethylenetetramine, etc.).

The photographic emulsion can, if desired, be subjected to spectral sensitization or color intensifying sensitization by use of polymethine sensitizing dyes, such as cyanine, merocyanine, carbocyanine, etc., alone or in combination with each other, or in combination with styryl dyes.

To the photographic emulsion for the photographic light-sensitive member of this invention can be added various compounds in order to prevent the reduction in sensitivity and the occurrence of fog during the production process, storage or treatment of the photographic light-sensitive member. As such compounds, many heterocyclic compounds, e.g., 4-hydroxy-6-methyl-1,3,3a,7-tetrazaindene-3-methyl-benzothiazole, 1-phenyl-5-mercaptotetrazole, etc., mercury-containing compounds, mercapto compounds, metal salts, etc., are known. Examples of compounds which can be used as described in T.H. James and C.E.K. Mees, *The Theory of the Photographic Process,* 3rd Ed., Macmillan Co., (1966).

Where the photographic silver halide emulsion is used for the production of the color photographic light-sensitive member, the coupler may be incorporated in the silver halide emulsion layer. As such couplers, 4-equivalent diketomethylene based yellow couplers and 2-equivalent diketomethylene based yellow couplers can be used, e.g., compounds as described in U.S. Pat. Nos. 3,277,157, 3,408,194, 3,551,155, Japanese Patent Application (OPI) Nos. 26133/72, 66836/73, etc., (the term "OPI" as used herein refers to a "published unexamined Japanese patent application"); 4-equivalent or 2-equivalent pyrazolone based magenta couplers and indazolone based magenta couplers, e.g., those compounds as described in U.S. Pat. Nos. 2,600,788, 3,214,437, 3,476,560, Japanese Patent Publication No. 25133/72, etc.; α-naphthol based cyan couplers and phenol based cyan couplers, e.g., those compounds as described in U.S. Pat. Nos. 2,474,293, 3,311,476, 3,481,741, etc.; and so forth. In addition, those couplers capable of releasing development controlling agents, as described in U.S. Pat. Nos. 3,227,554, 3,253,924, 3,379,529, 3,617,291, 3,770,436, etc., can also be used.

The silver halide emulsion layer and other hydrophilic colloidal layers in the photographic light-sensitive material of this invention can be hardened by various organic or inorganic hardeners (alone or in combination with each other). Typical examples of such hardeners include aldehyde based compounds such as mucochloric acid, formaldehyde, trimethylolmelamine, glyoxazole, 2,3-dihydroxy-1,4-dioxane, 2,3-dihydroxy-5-methyl-1,4-dioxane, succinaldehyde, glutaraldehyde, etc.; active vinyl compounds such as divinylsulfone, methylenebismaleimide, 1,3,5-triacryloyl-hexahydro-s-triazine, 1,3,5-trivinylsulfonyl-hexahydro-s-triazinebis(-vinylsulfonylmethyl) ether, 1,3-bis(vinylsulfonylmethyl)propanol-2, bis(α-vinylsulfonylacetamido)ethane, etc.; active halogen compounds such as 2,4-dichloro-6-hydroxy-s-triazine sodium salt, 2,4-dichloro-6-methoxy-s-triazine, etc.; ethyleneimine compounds such as 2,4,6-triethyleneimino-s-triazine, etc., and so forth.

To the photographic layer of this invention may be added surface active agents, singly or in combination with each other. These surface active agents are typically used as auxiliary coating agents, but are sometimes used for other purposes, for example, emulsion-dispersion, improvements in photographic characteristics (e.g., sensitization, etc.), adjustment in charging, etc. Examples of such surface active agents include natural surface active agents such as saponin, etc.; nonionic surface active agents such as alkyleneoxide-, glycerine-, and glycidol-based surface active agents; cationic surface active agents such as high alkylamines, quaternary ammonium salts, heterocyclic compounds, e.g., pyridine, etc., phosphoniums or sulfoniums, etc.; anionic surface active agents containing acidic groups, e.g., carboxylic acid, sulfonic acid, phosphoric acid, sulfates, phosphates, etc.; and amphoteric surface active agents such as amino acids, aminosulfonic acids, sulfuric acid or phosphoric acid esters of aminoalcohol, etc.

Examples of such surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478, 3,507,660, British Pat. No. 1,198,450, and Ryohei Oda et al., *Synthesis and Application of Surface Active Agents,* Maki Shoten, Tokyo (1964), A.W. Perry, *Surface Active Agents,* Interscience Publication Incorporated (1958), and J.P. Sisley, *Encyclopedia of Active Agents,* Vol. 2, Chemical Publish Co., (1964).

Incorporation of the polymer or copolymer having the repeating unit of the formula (I) in the surface protective layer in combination with a fluorine-based surface active agents further increases the antistatic properties. As fluorine-based surface active agents producing such effect, those compounds represented by the following formula (III) are preferably used:

$$(Cf)\text{-}(Y)_n \qquad \text{(III)}$$

wherein (Cf) represents a group containing at least three fluorine atoms and at least three carbon atoms, and having a valency n, and (Y) represents a group selected from

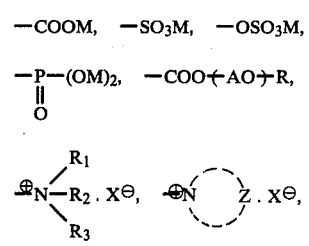

-continued

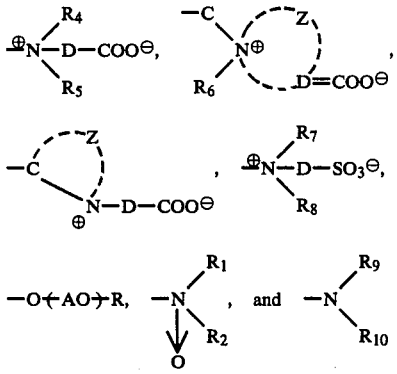

wherein M is hydrogen, a cation (e.g., an alkali metal, an alkaline earth metal, a quaternary ammonium base, etc.), or a hydrocarbon group containing from 1 to 18 carbon atoms; $-(AO)-$ is a polyalkyleneoxide group selected from polyoxyethylene, polyoxypropylene and polyoxyethylenepolyoxypropylene copolymer, all having a degree of polymerization of from 2 to 100; R is hydrogen, an alkyl group containing from 1 to 18 carbon atoms (e.g., methyl, ethyl, butyl, octyl, dodecyl, etc.), or an aryl group (e.g., phenyl, naphthyl, etc.); $R_1$, $R_2$, $R_3$, $R_4$, $R_5$, $R_6$, $R_7$ and $R_8$ are each an alkyl group containing from 1 to 4 carbon atoms (e.g., methyl, ethyl, butyl, etc.), or a hydroxyalkyl group (e.g., hydroxymethyl, γ-hydroxypropyl, etc.); $R_9$ and $R_{10}$ are each hydrogen or an alkyl group containing from 1 to 4 carbon atoms (e.g., methyl, ethyl, secondary butyl, etc.); X is a halogen atom (e.g., chlorine, bromine, iodine, etc.) or $R—O—SO_2—O^{\ominus}$; Z is an atom or a group of atoms required for forming a 5- or 6-membered ring (e.g., a pyrrole ring, an imidazoline ring, an oxazole ring, a pyridine ring, a pyrimidine ring, etc.) in combination with N; and D is an alkylene group containing from 1 to 5 carbon atoms; and n is an integer of 1 or 2.

Examples of the compounds represented by the formula (III) which can be used in this invention are shown below:

$CF_3(CF_2)_6COONH_4$ (III)-1

$CF_3(CF_2)_9—(CH_2)_{10}—COOH$ (III)-2

$CF_3(CF_2)_7SO_2—N(C_3H_7)—CH_2CH_2O(CH_2)_3SO_3Na$ (III)-3

$CF_3—C(C_2H_5)_2—CH(CF_3)—CF(CF_3—Cl)—COONa$ (III)-4

$Cl—CF_2(CF(Cl)—CF_2)_4—COOH$ (III)-5

$H(CF_2CF_2)_5—COOH$ (III)-6

$HOOC—(CF_2—CF(Cl))_4—COOH$ (III)-7

$Cl(CF_2—CF(Cl))_3CF_2—COOK$ (III)-8

$CF_3(CF_2)_6—CH=CH—(CH_2)_3—COONa$ (III)-9

$CF_3(CF_2)_3—CF(CF_3)—(CH_2)_{10}—COONa$ (III)-10

(III)-11

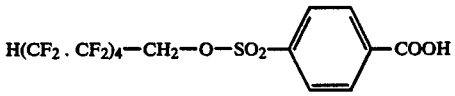

$CF_3(CF_2)_7—CO—N(CH_3)—(CH_2)_2COOH$ (III)-12

$Cl(CF_2—CF_2)_3—COONa$ (III)-13

$CF_3(CF_2)_3—CH_2CH_2—SO_2—N(C_2H_5)—CH_2—COONa$ (III)-14

$CF_3(CF_2)_7SO_2NH(CH_2)_3\overset{\oplus}{N}(CH_3)_2—(CH_2)_3SO_3^{\ominus}$ (III)-15

-continued $CF_3(CF_2)_7SO_2NH(C_3H_7)$ (III)-16

$CF_3(CF_2)_7SO_2-N(C_3H_7)-CH_2CH_2OH$ (III)-17

$CF_3-(CF_2)_7-SO_2-N(C_2H_5)-CH_2-COONa$ (III)-18

$CF_3-(CF_2)_7-SO_2-N(C_3H_7)-CH_2-COOK$ (III)-19

$CF_3(CF_2)_7-SO_3K$ (III)-20

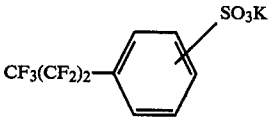
(III)-21

$CF_3(CF_2)_7-SO_2-N(C_2H_5)-(CH_2)_6-COOK$ (III)-22

$CF_3(CF_2)_{11}-CH_2-O-SO_3Na$ (III)-23

$CF_3(CF_2)_6-COO(CH_2)_3-SO_3K$ (III)-24

$H(CF_2)_6-CH_2-O-(CH_2)_3-SO_3Na$ (III)-25

$NaO_3S-CH(CH_2-COOCH_2-(CF_2)_6-H)-COOCH_2-(CF_2)_6-H$ (III)-26

$NaO_3S-CH(CH_2COOCH_2-(CF_2)_6-H)-COOC_8H_{17}$ (III)-27

$C_{16}H_{33}-CH(SO_3Na)-COOCH_2-CF_3$ (III)-28

$CF_3-C(C_2F_5)_2-C(CF_3)(SO_3Na)-CHF-CF_3$ (III)-29

$NaO_3S-CH(CH_2-COO-CH_2-CH_2-N(C_3H_7)-SO_2-C_8F_{17})-COO-CH_2-CH_2-N(C_3H_7)-SO_2-C_8F_{17}$ (III)-30

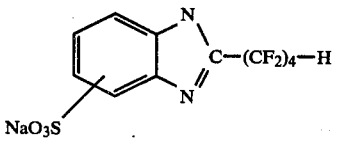
(III)-31

$H-(CF_2)_5-CH_2-P(=O)(OH)_2$ (III)-32

$H-(CF_2)_8-P(=O)(ONa)_2$ (III)-33

-continued $CF_3(CF_2)_7-SO_2-N(C_3H_7)-CH_2CH_2O(CH_2CH_2-O)_{20}-H$ (III)-34

$CF_3C(C_2F_5)_2-C(CF_3)(CH_2-O-(CH_2CH_2O)_4H)-CHF-CF_3$ (III)-35

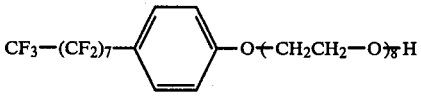
(III)-36

$CF_3-(CF_2)_7-N(C_2H_5)-CH_2CH_2-O(CH_2CH_2-O)_{13}-H$ (III)-37

$CF_3-(CF_2)_7-SO_2-N(C_2H_5)-(CH_2)_2O(CH_2-CH(CH_3)-O)_4(CH_2CH_2-O)_{20}-C_4H_9$ (III)-38

$CF_3(CF_2)_7SO_2-NH(CH_2)_3-\oplus N-(CH_3)_3 \,.\, I^{\ominus}$ (III)-39

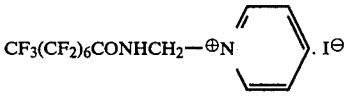
(III)-40

$CF_3-C(C_2F_5)_2-CH(CF_3)-CF(CF_3)-CONH(CH_2)_3-\oplus N(C_2H_5)(CH_2CH_2OH)-C_2H_5 \,.\, Cl^{\ominus}$ (III)-41

$CF_3(CF_2)_9-CONH(CH_2)_3-\oplus N(CH_3)_2-CH_2-COO^{\ominus}$ (III)-42

$CF_3(CF_2)_7-SO_2-N(C_3H_7)-(CH_2)_3-\oplus N(C_2H_5)_2-CH_2-COO^{\ominus}$ (III)-43

$CF_3(CF_2)_7-SO_2NH(CH_2)_3-N(CH_3)_2 \rightarrow O$ (III)-44

$Cl(CF_2-CFCl)_4-CF_2-CONH(CH_2)_3-N(CH_3)_2 \rightarrow O$ (III)-45

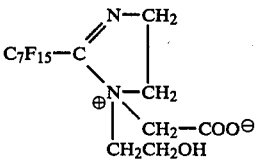
(III)-46

$C_7F_{15}-C(=N-CH_2)-N(CH_2)-\oplus N(CH_2-COO^{\ominus})(CH_2CH_2OH)$ $CF_3-(CF_2)_8-CH(OCOCH_3)_2$ (III)-47

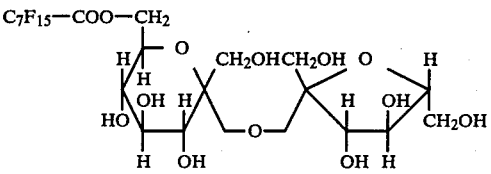
(III)-48

-continued

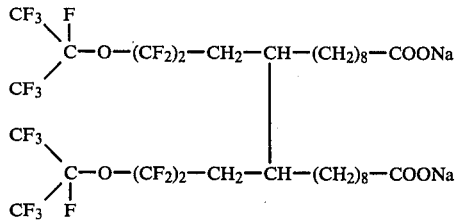

(III)-49

These compounds or homologous compounds which can be used in this invention can be synthesized by the methods as described, for example, in U.S. Pat. Nos. 2,559,751, 2,567,011, 2,732,398, 2,764,602, 2,806,866, 2,809,998, 2,915,376, 2,915,528, 2,934,450, 2,937,098, 2,957,031, 3,472,894, 3,555,089, 3,589,906, 3,666,478, Japanese Patent Publication Nos. 37304/70, 26687/77, Japanese Patent Application (OPI) Nos. 9613/72, 46733/74, 32322/76, *Journal of Chemical Society*, p. 2789, (1950), and pp. 2574 and 2640, (1957), *Journal of American Chemical Society*, Vol. 79, p. 2549, (1957), and *Journal of Japan Oil Chemists Soc.*, Vol. 12, p. 653.

Some of the fluorine-based compounds which can be used in this invention are available on the market under the trade names of Magafac F (e.g., F-110, F-120, F-144, F-150, etc.) by Dai-Nippon Ink & Chemicals, Inc., FC (e.g., FC-95, FC-128, FC-134, FC-161, FC-170, FC-176, FC-430, FC-431, etc.) by Minnesota Mining and Manufacturing Co., Monflor (e.g., Monflor-31, -32, -51, -52, -53, -71, -91, etc.) by Imperial Chemical Industry Co., Zonyls (e.g., Zonyl-S13) by E. I. Du Pont de Nemours Co., and Licowet VPF by Farberk Hoechst A. G.

The amount of the fluorine-based surface active agent coated is preferably from 0.1 to 100 mg/m$^2$ of photographic film, with the range of from 0.5 to 50 mg/m$^2$ of photographic film being particularly preferred. The weight ratio of the fluorine-based surface active agent to the betaine polymer represented by the formula (I) is preferably from 1/5,000 to 1/10 and more preferably from 1/2,000 to 1/50.

The photographic layer of this invention can contain a lubricating composition, e.g., modified silicone as described in U.S. Pat. Nos. 3,079,837, 3,080,317, 3,545,970, and 3,294,537, and in Japanese Patent Application (OPI) No. 129520/77.

The photographic light-sensitive members of this invention can contain in the photographic layer thereof those polymer latexes as described in U.S. Patents 3,411,911, 3,411,912, Japanese Patent Publication No. 5331/70, etc., and as a matting agent, silica, strontium sulfate, barium sulfate, polymethyl methacrylate, etc.

Also according to this invention, the problems resulting from the formation of scum during the production and/or use of the photographic light-sensitive members can be eliminated. For example, the formation of static marks resulting from the contact berween the emulsion layer and the back surface of the photographic light-sensitive member, between the emulsion layers, and between the photographic light-sensitive member and those substances with which it often comes in contact, such as rubbers, metals, plastics and a fluorescent intensifying screen, can be significantly reduced.

Using the compounds represented by the formula (I) as a dispersing agent for silver halide or a protective colloid in combination with gelatin, and incorporating the compounds in the photographic emulsion to increase the dimensional stability of the coated emulsion film are known and described, for example, in U.S. Pat. Nos. 2,846,417, 3,832,185, 3,411,912, 3,549,605, British Pat. No. 786,344, German Pat. No. 1,547,679, and Japanese Patent Publication No. 19951/70, etc.

In these specifications, however, there is no descriptions or disclosure concerning the features of the compounds of this invention as an antistatic agent and, furthermore, no teachings that the addition of these compounds to the surface protective layer can be used to obtain improved antistatic properties. Also, the addition of the compounds represented by the formula (I) of this invention increases the covering power.

The following examples are given to illustrate this invention in greater detail, but the invention is not limited thereto.

EXAMPLE 1

Samples 1 to 15 were prepared by providing in sequence an emulsion layer and a protective layer on both sides of a support by a conventional method, the support being an about 175μ thick polyethylene terephthalate film. The composition of each layer was as follows:

Emulsion Layer (about 5μ)

Binder: gelatin 2.5 g/m$^2$
Amount of silver coated: 5 g/m$^2$
Composition of silver halide: AgI 1.5 mol% and AgBr 98.5 mol%
Hardener: 2,4-dichloro-6-hydroxy-1,3,5-triazine sodium salt 0.4 g/100 g gelatin
Anti-foggant: 1-phenyl-5-mercaptotetrazole 0.5 g/Ag 100 g Protective Layer (about 1μ)

Binder: gelatin 1.7 g/m$^2$ and potassium polystyrene sulfonate (average molecular weight about 700,000) 0.3 g/m$^2$
Coating agent: N-oleoyl-N-methyltaurine sodium salt 7 mg/m$^2$ In Examples 2 to 13, the compounds of this invention and fluorine based surface active agents as shown in Table 1 were added to the protective layer, whereas in Example 1, no such compounds were added. For comparison, Examples 14 and 15 were prepared by adding the following Comparative Compounds A and B, respectively, to the protective layer.

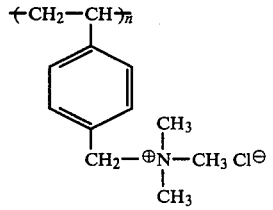

Compound A

-continued $$\left(CH_2-\underset{\underset{COONa}{|}}{CH}\right)_n$$ Compound B These examples were allowed to stand at 25° C. and 25% RH for 2 hours and then brought in contact with a rubber roller and rubbed in a dark room under the same conditions as above. Thereafter, they were developed with the following developer, and after fixing and water washing, the formation of static marks was examined.

| Composition of Developer | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml (pH: 10.2) |

On the other hand, the unexposed samples were exposed to light through a filter, viz., Filter-SP-14, produced by Fuji Photo Film Co., Ltd., at an exposure amount of 1.6 CHM by use of a tungsten lamp, and thereafter they were developed with the same developer as used above (35° C., 30 seconds), fixed and washed with water. With the thus-processed samples, the sensitivity and fog were examined. The unexposed samples were stored for 3 days at 50° C., and thereafter they were exposed and processed under the same conditions as above. By measuring the sensitivity and fog, the influences of the added compounds on the photographic characteristics were examined.

The results are shown in Table 1.

TABLE 1

| Sample No. | Compound of This Invention (Formula (I) or (II)) | Amount Coated (mg/m²) | Fluorine-Based Surface Active Agent (Formula (III)) | Amount Coated (mg/m²) | Formation of Static Marks | Photographic Properties: Just after Coating Fog | Just after Coating Sensitivity | After Storage Fog | After Storage Sensitivity |
|---|---|---|---|---|---|---|---|---|---|
| 1 | none | — | none | — | D | 0.16 | 0 | 0.18 | −0.01 |
| 2 | (1) | 800 | none | — | A-B | 0.16 | 0 | 0.16 | 0 |
| 3 | (4) | 800 | none | — | A-B | 0.16 | 0 | 0.16 | 0 |
| 4 | (6) | 800 | none | — | A-B | 0.16 | 0 | 0.16 | 0 |
| 5 | (7) | 800 | none | — | A-B | 0.16 | 0 | 0.16 | −0.01 |
| 6 | (9) | 800 | none | — | A-B | 0.16 | 0 | 0.16 | −0.01 |
| 7 | (10) | 800 | none | — | A-B | 0.17 | −0.01 | 0.17 | −0.02 |
| 8 | (1) | 800 | (III)-19 | 2 | A | 0.16 | 0 | 0.16 | 0 |
| 9 | (1) | 800 | (III)-42 | 2 | A | 0.16 | 0 | 0.16 | 0 |
| 10 | (7) | 800 | (III)-39 | 2 | A | 0.16 | 0 | 0.16 | 0 |
| 11 | — | — | (III)-19 | 2 | D | 0.16 | 0 | 0.18 | −0.01 |
| 12 | — | — | (III)-42 | 2 | D | 0.16 | 0 | 0.18 | −0.01 |
| 13 | — | — | (III)-39 | 2 | D | 0.17 | 0 | 0.18 | −0.02 |
| 14 | Comparative Compound A | 800 | none | — | B | 0.22 | +0.05 | 0.50 | impossible to evaluate |
| 15 | Comparative Compound B | 800 | none | — | B | 0.20 | −0.02 | 0.30 | −0.10 |

In Table 1, the extent of formation of static marks was evaluated as follows:

A: No static marks were observed.

B. Some static marks were observed.

C: Many static marks were observed.

D: On the nearly whole surface, static marks were observed.

The sensitivity is expressed by indicating a deviation from the basic sensitivity as an absolute value of log E, said basic sensitivity being the one of a control sample (Sample 1) just after the preparation thereof. No deviation from the basic sensitivity indicates that the photographic characteristics are not adversely affected.

As can be seen from Table 1, the compounds of this invention produce excellent antistatic effects such that almost no static marks are formed and, at the same time, exert no adverse influences on the photographic characteristics, such as fog, sensitivity, etc. Furthermore, it can be seen that the use of the compounds of this invention in combination with the fluorine-based surface active agents further increases the antistatic effect. On the other hand, while Comparative Compounds A and B produce good antistatic effect, they exert adverse influences on the photographic characteristics.

EXAMPLE 2

Samples 16 to 19, having a structure consisting of a cellulose triacetate support, an antihalation layer on the support, a red-sensitive layer on the antihalation layer, an intermediate layer on the red-sensitive layer, a green-sensitive layer on the intermediate layer, a yellow filter layer on the green-sensitive layer, a blue-sensitive layer on the yellow filter layer, and a protective layer on the blue-sensitive layer were produced by a conventional method. The composition of each layer was as follows:

Antihalation Layer

Binder: gelatin 4.4 g/m²

Hardener: 1,3-bis(vinylsulfonyl)propanol-2 1.2 g/100 g binder

Auxiliary coating agent: sodium dodecylbenzenesulfonate 4 mg/m²

Antihalation component: black colloidal silver 0.4 g/m²

Red-Sensitive Layer

Binder: gelatin 7 g/m²

Hardener: 1,3-bis(vinylsulfonyl)propanol-2 1.2 g/100 g binder

Auxiliary coating agent: sodium dodecylbenzenesulfonate 10 mg/m²

Amount of silver coated: 3.1 g/m²

Composition of silver halide: $AgI_2$ 2 mols and AgBr 98 mols

Anti-foggant: 4-hydroxy-6-methyl-1,3,3a,7-tetrazaindene 0.9 g/Ag 100 g

Coloring agent: 1-hydroxy-4-(2-acetylphenyl)azo-N-[4-(2,4-di-tert-amylphenoxy)butyl]-2-naphthamide 38 g/Ag 100 g Sensitizing dye: anhydro-5,5'-dichloro-9-ethyl-3,3'-di(3-sulfopropyl)thiacarbocyaninehydroxide pyridium salt 0.3 g/Ag 100 g Intermediate Layer Binder: gelatin 2.6 g/m$^2$ Hardener: 1,3-bis(vinylsulfonyl)propanol-2 1.2 g/100 g binder Auxiliary coating agent: sodium dodecylbenzenesulfonate 12 mg/m$^2$ Green-Sensitive Layer Binder: gelatin 6.4 g/m$^2$ Hardener: 1,3-bis(vinylsulfonyl)propanol-2 1.2 g/100 g binder Auxiliary coating agent: sodium dodecylbenzenesulfonate 9 mg/m$^2$ Amount of silver coated: 2.2 g/m$^2$ Composition of silver halide: AgI 3.3 mols and AgBr 96.7 mols Stabilizer: 4-hydroxy-6-methyl-1,3,3a,7-tetrazaindene 0.6 g/Ag 100 g Coloring agent: 1-(2,4,6-trichlorophenyl)-3-{3-(2,4-di-tert-amylphenoxy)acetoazido}-4-(4-methoxyphenyl)azo-5-pyrazolone 37 g/Ag 100 g Sensitizing dye: anhydro-5,5'-diphenyl-9-ethyl-3,3'-di(2-sulfoethyl)oxacarbocyaninehydroxide pyridium salt 0.3 g/Ag 100 g Yellow Filter Layer Binder: gelatin 2.3 g/m$^2$ Filter component: yellow colloidal silver 0.7 g/m$^2$ Hardener: 1,3-bis(vinylsulfonyl)propanol 1.2 g/100 g binder Surface active agent: 2-sulfonatosuccinic acid bis(2-ethylhexyl)ester sodium salt 7 mg/m$^2$ Blue-Sensitive Layer Binder: gelatin 7 g/m$^2$ Hardener: 1,3-bis(vinylsulfonyl)propanol-2 1.2 g/100 g binder Auxiliary coating agent: sodium dodecylbenzenesulfonate 8 mg/m$^2$ Composition of silver halide: AgI 3.3 mols and AgBr 96.7 mols Stabilizer: 4-hydroxy-6-methyl-1,3,3a,7-tetrazaindene 0.4 g/Ag 100 g Coloring Agent: 2'-chloro-5'-[2-(2,4-di-tertamylphenoxy)butyramido]-α-(5,5'-dimethyl-2,4-dioxo-3-oxazolidinyl)-α-(4-methoxybenzoyl) acetoanilide 45 g/Ag 100 g Protective Layer Binder: gelatin 2 g/m$^2$ and styrene-maleic anhydride (1:1) copolymer (average molecular weight: about 100,000) 0.3 g/m$^2$ Hardener: 1,3-bis(vinylsulfonyl)propanol-2 1.2 g/100 g binder Auxiliary coating agent: sodium dioctylsulfosuccinate 5 mg/m$^2$ In Samples 17 to 19, Compounds (2) and (6) of this invention and Comparative Compound A, respectively, were added to the protective layer in an amount of 900 mg/m$^2$, whereas in Sample 16, no such compounds were added.

These samples were developed and examined in the antistatic properties in the same manner as in Example 1 with the exception that a usual color development was employed in place of the black and white development.

The results are shown in Table 2.

TABLE 2

| Sample No. | Antistatic Agent | | Extent of Formation of Static Marks |
|---|---|---|---|
| 16 | none | Control | D |
| 17 | Compound (2) | Invention | A |
| 18 | Compound (6) | Invention | A |
| 19 | Comparative Compound A | Comparison | B |

As can be seen from Table 2, in those samples in which the compounds of this invention were used, almost no static marks were observed. On exposing these samples to light according to the JIS method (JIS K-7604 (1976)) and subjecting to a usual color development processing in Sample 19 the fog markedly increased in all the blue-, green- and red-sensitive layers, whereas in Samples 17 and 18 in which the compounds of this invention were used, almost no adverse influences were observed.

EXAMPLE 3

Light-sensitive members as in Sample 1 of Example 1 were dipped for 5 seconds in a 2% by weight aqueous solution of the compound as shown in Table 3 and then allowed to dry under the conditions of 25° C. and 65% RH. These samples were subjected in moisture at 25° C. and 25% RH for 2 hours, and under the same conditions as above, the antistatic properties were examined in the same manner as in Example 1.

The results are shown in Table 3.

TABLE 3

| Sample No. | Antistatic Agent | | Extent of Formation of Static Marks |
|---|---|---|---|
| 20 | none | Control | D |
| 21 | Compound (4) | Invention | A |
| 22 | Compound (6) | Invention | A |
| 23 | Compound (10) | Invention | A |

As can be seen from Table 3, the coating of the compounds of this invention by dipping is useful for the improvement of the antistatic properties.

EXAMPLE 4

In order to examine the formation of scum in a fixer, Samples 1, 2, 3, 4, 9 and 14 used in Example 1 were processed with about 12 l of the fixer by use of a simple automatic developer produced by Fuji Photo Film Co., Ltd. (trademark: Fuji X-ray processor RN; processing capacity: for each of the developer and fixer, 12 l) and, thereafter, the formation of scum in the fixer was observed with naked eye. The developer and fixer used were the developer and fixer for the processing of medical X-ray films produced by Fuji Photo Film Co., Ltd.

The results are shown in Table 4.

TABLE 4

| Sample | Extent of Formation of Scum in Fixer | |
|---|---|---|
| 1 | none | Control |
| 2 | none | Invention |
| 3 | none | Invention |
| 4 | none | Invention |
| 5 | none | Invention |
| 9 | none | Invention |
| 14 | A significant amount | Comparison |

TABLE 4-continued

| Sample | Extent of Formation of Scum in Fixer |
|---|---|
| | of scum was formed. |

As can be seen from Table 4, the compounds of this invention are free from the formation of scum.

While the invention has been described in detail and with reference to specific embodiments thereof, it will be apparent to one skilled in the art that various changes and modifications can be made therein without departing from the spirit and scope thereof.

What is claimed is:

1. A photographic element comprising:

a support;

a light-sensitive silver halide layer; and a protective layer wherein said protective layer is comprised of a polymer or copolymer in an amount of 0.005 to 5 grams per square meter of said element, said polymer or copolymer having a repeating unit represented by the formula (I)

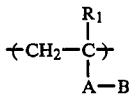

(I)

wherein R1 represents hydrogen or a methyl group, A represents a —COO— or —CONH— group, and B represents

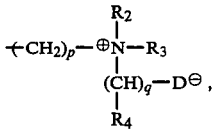

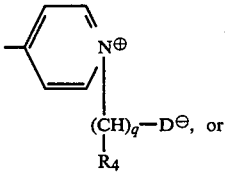

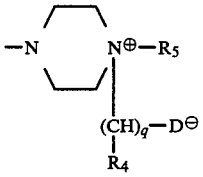

wherein $R_2$ and $R_3$ represent an alkyl group containing from 1 to 6 carbon atoms; $R_4$ represents hydrogen or a methyl group; $R_5$ represents an alkyl group containing from 1 to 3 carbon atoms; p is an integer of from 2 to 6; when $R_4$ is hydrogen, q is an integer of from 1 to 4, and, when $R_4$ is a methyl group, q is 1; and $D^-$ represents a $—COO^-$ or $—SO3^-$ group, the compound of formula (I) being present in said copolymer in an amount sufficient to effect the antistatic properties of the photographic element.

2. A photographic light-sensitive member as in claim 1, wherein B is

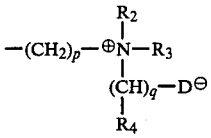

3. A photographic light-sensitive member as in claim 1 or 2 comprising in the surface protective layer a polymer having a repeating unit represented by the formula (I).

4. A photographic light-sensitive member as in claim 1 or 2 comprising in the surface protective layer a copolymer having a repeating unit represented by the formula (I).

5. A photographic light-sensitive member as in claim 4, wherein the copolymer comprises at least 50 mol% and is represented by the formula (I).

6. A photographic light-sensitive member as in claim 1 or 2, wherein the photographic light-sensitive member is a photographic film and the amount of polymer or copolymer having a repeating unit according to formula (I) is from 0.005 to 5 g/m$^2$ of the photographic film.

7. A photographic light-sensitive member as in claim 1 or 2, wherein the photographic light-sensitive member is a photographic film and the amount of polymer or copolymer having a repeating unit according to formula (I) is from 0.01 to 1.0 g/m$^2$ of the photographic film.

8. A photographic light-sensitive member as in claim 3, wherein the photographic light-sensitive member is a photographic film and the amount of polymer having a repeating unit according to formula (I) is from 0.005 to 5 g/m$^2$ of the photographic film.

9. A photographic light-sensitive member as in claim 3, wherein the photographic light-sensitive member is a photographic film and the amount of polymer having a repeating unit according to formula (I) is from 0.01 to 1.0 g/m$^2$ of the photographic film.

10. A photographic light-sensitive member as in claim 4, wherein the photographic light-sensitive member is a photographic film and the amount of copolymer having a repeating unit according to formula (I) is from 0.005 to 5 g/m$^2$ of the photographic film.

11. A photographic light-sensitive member as in claim 4, wherein the photographic light-sensitive member is a photographic film and the amount of copolymer having a repeating unit according to formula (I) is from 0.01 to 1.0 g/m$^2$ of the photographic film.

12. A photographic light-sensitive member as in claim 1 or 2, wherein the surface protective layer further includes a fluorine-based surface active agent.

13. A photographic light-sensitive member as in claim 12, wherein said fluorine-based surface active agent comprises a compound represented by the formula (III)

$$(Cf)\text{-}(Y)_n \qquad \text{(III)}$$

wherein (Cf) represents a group containing at least three fluorine atoms and at least three carbon atoms, and has a valency n, and (Y) represents a group selected from $$—COOM, \quad —SO_3M, \quad —OSO_3M,$$

-continued

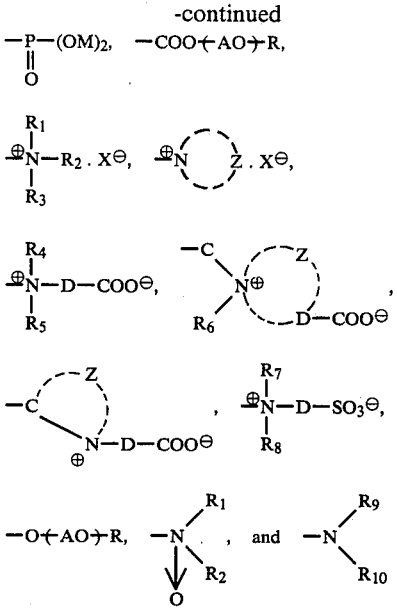

wherein M is hydrogen, a cation, or a hydrocarbon group containing from 1 to 18 carbon atoms; $-(AO)-$ is a polyalkyleneoxide group selected from polyoxyethylene, polyoxypropylene and polyoxyethylene-polyoxypropylene copolymer, having a degree of polymerization of from 2 to 100; R is hydrogen, an alkyl group containing from 1 to 18 carbon atoms, or an aryl group; $R_1$, $R_2$, $R_3$, $R_4$, $R_5$, $R_6$, $R_7$ and $R_8$ are each an alkyl group containing from 1 to 4 carbon atoms, or a hydroxyalkyl group; $R_9$ and $R_{10}$ are each hydrogen or an alkyl group containing from 1 to 4 carbon atoms; X is a halogen atom or $R\text{-}O\text{-}SO_2\text{-}O^{\ominus}$; Z is an atom or a group of atoms required for forming a 5- or 6-membered ring in combination with N; and D is an alkylene group containing from 1 to 5 carbon atoms; and n is an integer of 1 or 2.

14. A photographic light-sensitive member as in claim 12, wherein the photographic light-sensitive member is a photographic film and the amount of the fluorine-based surface active agent is from 0.1 to 100 mg/m$^2$.

15. A photographic light-sensitive member as in claim 13, wherein the photographic light-sensitive member is a photographic film and the amount of the fluorine-based surface active agent is from 0.1 to 100 mg/m$^2$.

16. A photographic light-sensitive member as in claim 12, wherein the photographic light-sensitive member is a photographic film and the amount of the fluorine-based surface active agent is from 0.5 to 50 mg/m$^2$.

17. A photographic light-sensitive member as in claim 13, wherein the photographic light-sensitive member is a photographic film and the amount of the fluorine-based surface active agent is from 0.5 to 50 mg/m$^2$.

18. A photographic light-sensitive member as in claim 12, wherein the weight ratio of the fluorine-based surface active agent to the weight of the repeating unit of formula (I) is from 1/5,000 to 1/10.

19. A photographic light-sensitive member as in claim 13, wherein the weight ratio of the fluorine-based surface active agent to the weight of the repeating unit of formula (I) is from 1/5,000 to 1/10.

20. A photographic light-sensitive member as in claim 12, wherein the weight ratio of the fluorine-based surface active agent to the weight of the repeating unit of formula (I) is from 1/2,000 to 1/50.

21. A photographic light-sensitive member as in claim 13, wherein the weight ratio of the fluorine-based surface active agent to the weight of the repeating unit of formula (I) is from 1/2,000 to 1/50.

22. A photographic light-sensitive member as claimed in claim 1, wherein the amount of the compound of formula (I) present in said copolymer is at least 50 mol % of the units of said copolymer.

* * * * *